United States Patent [19]

Nagashima

[11] Patent Number: 4,548,169

[45] Date of Patent: Oct. 22, 1985

[54] CARBURETOR CHAMBER

[75] Inventor: Akira Nagashima, Kawasaki, Japan

[73] Assignee: Kioritz Corporation, Tokyo, Japan

[21] Appl. No.: 634,630

[22] Filed: Jul. 26, 1984

[30] Foreign Application Priority Data

Aug. 1, 1983 [JP] Japan ..... 58-140710

[51] Int. Cl.[4] ..... F02B 77/02

[52] U.S. Cl. ..... 123/195 C; 123/196 R; 123/198 E

[58] Field of Search ..... 123/52 M, 195 R, 195 C, 123/198 E, 196 R

[56] References Cited

U.S. PATENT DOCUMENTS

| | | | |
|---|---|---|---|
| 3,332,411 | 7/1967 | Bloom et al. | 123/196 R |
| 3,680,608 | 1/1972 | Emmerich et al. | 143/32 |
| 4,224,919 | 9/1980 | Appelbaum | 123/198 E |
| 4,285,309 | 8/1981 | Johansson | 123/195 C |

*Primary Examiner*—Craig R. Feinberg
*Attorney, Agent, or Firm*—Karl W. Flocks; Sheridan Neimark; A. Fred Starobin

[57] ABSTRACT

Disclosed is a carburetor chamber arranged such that its casing having an opening at the top is fixed and this casing is provided, at its interior, with a carburetor and, at its bottom wall, with a path of feeding under pressure chain lubricating oil and, at its rear wall, with a through hole for permitting the passage therethrough of a throttle valve operation lever for the carburetor and, at its front wall, with an attachment section for a gas pipe and, at its opening, with an air filter, whereby the communication of an air-fuel mixture outlet of the carburetor with a suction port of an engine cylinder is effected through the gas pipe so that a connecting of the gas pipe with the suction port of the cylinder may be effected slidably and in a hermetically sealed condition.

3 Claims, 1 Drawing Figure

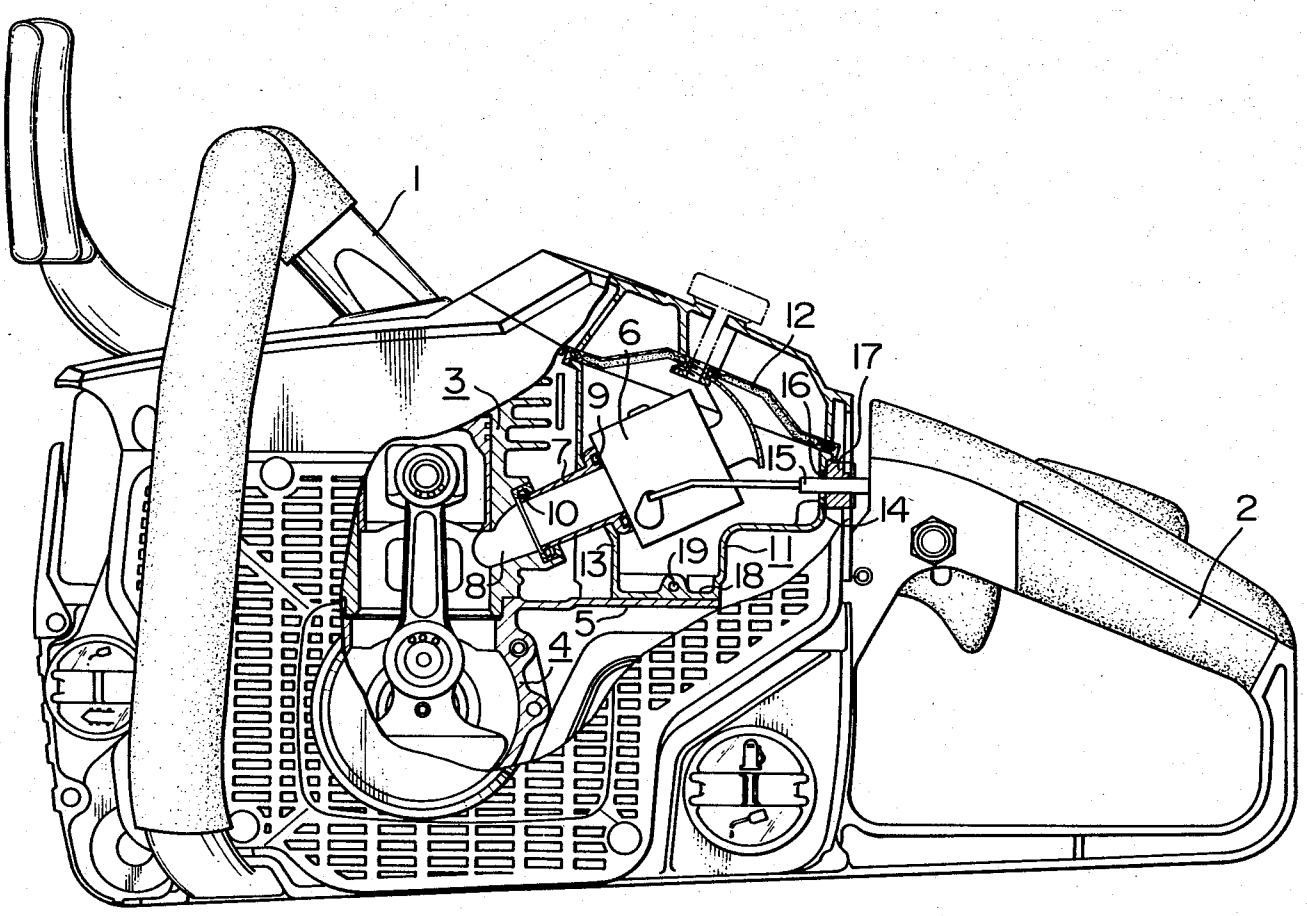
1
2
3
4
5
6
7
8
9
10
11
12
13
14
15
16
17
18
19

CARBURETOR CHAMBER

BACKGROUND OF THE INVENTION

The present invention relates to a carburetor chamber for a power-driven machine, particularly a chain saw, which is provided, at its top, with an engine cylinder and, at its lower part, with an engine crank case and, at the rear part of the cylinder, with a carburetor in a manner that the carburetor is juxtaposed with the cylinder.

Generally, in a machine arranged to operate with the use of an internal combustion engine as a power source, a connecting or communicating of an air-fuel mixture outlet of a carburetor with a suction port of a engine cylinder is effected through a bellows type gas pipe in consideration of the thermal expansion, etc.

In this case, however, the fuel in the air-fuel mixture is very likely to attach to and stay on an inner surface of the bellows, so that the air-fuel ratio is varied due to a dropping of such fuel, so that unexpected variations in revolution occur during an idling speed of the engine. This becomes a cause of the troubles.

Further, in the chain saw, an elongate flexible pipe and the like are used to feed chain-lubricating oil under pressure. For this reason, for example, the problems of pipe breakage and oil leakage are liable to arise as the particular problems of the chain saw. Further the inconveniences such as that of making it difficult to adjust or control the engine output and the engine idling speed due, for example, to a displacement in attachment position of the throttle valve operation lever of the carburetor, have hitherto arisen.

SUMMARY OF THE INVENTION

The present invention is intended to provide a novel carburetor chamber in order to solve the abovementioned problems inherent in the prior art and is characterized in that it has a gas pipe of simple structure prepared in consideration of its thermal expansion and heat insulating effect, as well as a casing of high dimensional precision prepared in consideration of the readiness with which it is machined and assembled.

That is to say, the present invention is characterized in that, in a chain saw having an engine cylinder at its top and an engine crank case at its lower part and a carburetor at a rear part of the cylinder, an air-fuel mixture outlet of the carburetor is communicated with a suction port of the cylinder through a gas pipe made of a heat insulation material; a substantially horizontal flat portion is provided at a position located rearwardly of a top portion of the crank case by extending the top portion; and a casing having an opening at its top is fixed on the flat portion, said casing being provided, at its interior, with the carburetor and, at its bottom wall, with a path of feeding under pressure a chain lubricating oil and, at its rear wall, with a through hole for permitting the passage therethrough of a throttle valve operation lever for the carburetor and, at its front wall, with an attachment section for the gas pipe and, at its opening, with an air filter, said communication of the air-fuel mixture outlet of the carburetor with the suction port of the cylinder being effected through the gas pipe so that a connecting of the gas pipe with each of the air-fuel mixture outlet and the suction port may be effected slidably and in a sealed condition.

Accordingly, according to the construction of the present invention, it is possible to cope with the thermal expansion of the parts without using a bellows type gas pipe as in the prior art and, at the same time, since the gas pipe is formed of a heat insulation material, it is possible to enhance the heat insulating effect of the carburetor and, at the same time, it is possible to make the inner surface of the gas pipe smooth and thereby reliably feed a desired air-fuel mixture to the cylinder, whereby it is possible to obtain a stable low-speed operation, as well as a desired acceleration performance, of the engine.

Further, the carburetor chamber is constructed by a casing secured to the extended flat portion of the crank case, whereby a fabricating and assembling of the constituent elements or parts are effected readily with high precision. Further, the positional relation between the carburetor and the gas pipe or throttle valve operation lever is precisely established and, at the same time, the communicating of the air-fuel mixture outlet of the carburetor and the suction port of the cylinder is effected through the gas pipe so that a connecting of the gas pipe with each of the air-fuel mixture outlet and the suction port of the cylinder may be effected slidably and in a reliably sealed condition. Further, the supplying of the air-fuel mixture is controlled by a precise opening and closing of the throttle valve, whereby it is possible, in cooperation with, for example, the heat insulating effect of the carburetor, to obtain a stable idling operation and an excellent acceleration performance of the engine.

Further, the path of feeding under pressure the chain lubricating oil is integrally provided in the bottom wall of the casing, whereby to eliminate the necessity of feeding the lubricating oil under pressure by using an elongate flexible pipe as in the prior art, whereby to solve the problems of pipe breakage and oil leakage from the pipe.

BRIEF DESCRIPTION OF THE DRAWING

The drawing shows a partially sectioned view of a main part of a chain saw embodying the present invention.

DETAILED DESCRIPTION OF THE PREFERRED EMBODIMENT

The construction of the present invention will now be described in connection with an embodiment illustrated in the appended drawing.

The drawing shows a portable chain saw according to an embodiment of the present invention. Although not shown, this chain saw has at its left side a guide bar wound with a saw chain and the sawing operation for a tree is carried out with a front handle 1 and a back handle 2 respectively gripped by operator's hands. A cylinder 3 and crank case 4 constituting a part of a vertical internal combustion engine are arranged such that the former is disposed upside and the latter disposed down. The crank case 4 has its upper end portion extended backwards to constitute a substantially horizontal flat portion 5.

A carburetor 6 and the cylinder 3 are allowed to communicate with each other through a gas pipe 7 made of an heat insulating material such as, for example, nylon and having a smooth inner surface. One end of the gas pipe 7 is sealed, through an O-ring member 9, to an air-fuel mixture outlet of the carburetor 6 and the other end thereof is also sealed, through an O-ring member 10, to a suction port 8 of the cylinder 3. The suction port 8 of the cylinder 3 is formed such that its end portion is made large in diameter, whereby an annular sealing member formed with a groove for receiving the O-ring member 10 therein is inserted into the large-diameter end portion of the suction port 8. Accordingly, when the gas pipe 7 is mounted as shown in the drawing, the O-ring member 10 in the groove of the annular sealing member is pressed onto, or against, the outer periphery of the gas pipe 7, whereby the sealing, or hermetical fitting, of the gas pipe 7 into the suction port 8 of the cylinder 3 is maintained. As a result, even when the cylinder 3 or gas pipe 7 is thermally expanded, the hermetically sealed connection therebetween can be maintained by such slidable sealing.

The carburetor 6 is disposed within a casing 11 to serve as the carburetor chamber fixed onto the flat portion 5 of the crank case 4 by means of, for example, screws. If, in this case, the casing 11 is formed of a heat insulation material, the heat insulation effect of the carburetor 6 becomes better. An air filter 12 is mounted on an opening provided in the top of this casing 11. The casing 11 has at its front wall section 13 an opening permitting the insertion therethrough of a small-diameter portion of the gas pipe 7. The carburetor 6 is secured to the front wall section 13 through a large-diameter portion of said one end of the gas pipe 7 and the O-ring member 9. A rear wall section 14 of the casing 11 is formed with a through hole 16 permitting the insertion therethrough of a throttle valve operation lever 15 for the carburetor 6. The operation lever 15 can be moved as specified or predetermined by a guide piece 17 juxtaposed with the through hole 16. The casing 11 is further integrally formed, at its bottom wall section 18, with a path 19 of feeding under pressure chain-lubricating oil, which oil feeding path 19 is directly connected to a discharge side of a manually-operable oil pump (not shown).

Accordingly, since the positional relation between the cylinder 3 and the crank case 4, and the positional relation between the crank case 4 and the casing 11, can be precisely determined, the relation between the position of mounting the carburetor 6 in the casing 11 and the position of disposing the gas pipe 7 or throttle-valve operation lever 15 or the like becomes precise. As a result, it is possible completely to prevent the occurrence of a displacement in position of the parts which occurred in the prior art. This not only improves the communication, under the hermetically sealed condition, of the air-fuel mixture outlet of the carburetor with the suction port 8 of the cylinder 3, but also makes it possible to precisely cover the variation in dimension of the associated parts due to the effect of the thermal expansion. Therefore, the hermetical sealing is not impaired due to the variation in temperature. Besides, it is possible to minimize the degree to which the sealed portions are worn. Further, since the heat of the cylinder 3 is prevented, by provision of the gas pipe 7 made of heat insulation material, from being directly transferred to the carburetor 6, it is possible to cause the air-fuel ratio to be maintained at a precise value in cooperation with the heat insulating effect of the casing 11. This enables a predetermined air-fuel mixture to be supplied to the engine, which enables enhancing the accelerating performance of the engine. Further, since, unlike the prior art gas pipe of bellows type, it is not necessary to provide any irregular portion on the inner surface of the gas pipe, any conventional inconvenience due to attachment or dropping of the fuel does not arise. Further, since the installment position of the carburetor 6 is precisely determined, the throttle valve operation lever 15 is precisely operated, whereby the opening and closing of the throttle valve are reliably effected. This increases the stability of the operation. Consequently, the unexpected troubles which may occur during the idling operation and low-speed operation of the engine are prevented.

What is claimed is:

1. In a chain saw having an engine cylinder at its top and an engine crank case at its lower part, with a carburetor arranged at a rear part, apart from said cylinder; a carburetor chamber arrangement characterized in that an air-fuel mixture outlet of said carburetor is communicated with a suction port of said cylinder through a gas pipe made of a heat insulation material; a substantially horizontal flat portion is provided at a position located rearwardly of a top portion of said crank case by extending said top portion; and a casing separate from said crank case having an opening at its top and which is fixed on said flat portion, said casing being provided, at its interior, with said carburetor and, at its bottom wall, integrally formed along therefor with a path of feeding under pressure chain lubricating oil therewithin and, at its rear wall, with a through hole for permitting the passage therethrough of a throttle valve operation lever for said carburetor and, at its front wall, with an attachment section for said gas pipe and, at said opening at its top, with an air filter, said communication of said air-fuel mixture outlet of said carburetor with said suction port of said cylinder being effected through said gas pipe so that a connecting of said gas pipe with said suction port may be effected slidably and in a sealed condition.

2. The carburetor chamber arrangement of claim 1 further characterized by said suction port of said cylinder having a diameter increasing from an interior wall of said cylinder outward to where it meets with said gas pipe to receive an end of said gas pipe, and sealing means between an outer wall of said gas pipe and an inner wall of said suction port.

3. The carburetor chamber arrangement of claim 1 further characterized by O-ring sealing means to allow the slidable sealed connection at each of said suction port and said air-fuel mixture outlet with opposite ends of said gas pipe.

* * * * *